US005502467A

United States Patent [19]

Hoisington et al.

[11] Patent Number: 5,502,467

[45] Date of Patent: Mar. 26, 1996

[54] INK JET PRINTHEAD WITH INK VISCOSITY CONTROL

[75] Inventors: Paul A. Hoisington, Norwich, Vt.; Michael A. Cockett, Lenham, England

[73] Assignee: Spectra, Inc., Hanover, N.H.

[21] Appl. No.: 206,765

[22] Filed: Mar. 7, 1994

[51] Int. Cl.[6] ..... B41J 2/01

[52] U.S. Cl. ..... 347/6; 347/17; 73/54.01

[58] Field of Search ..... 347/6, 7, 17, 88; 137/804, 805; 73/54.01, 54.42, 751

[56] References Cited

U.S. PATENT DOCUMENTS

| | | | |
|---|---|---|---|
| 3,616,809 | 11/1971 | Laakaniemi | 137/804 X |
| 3,829,751 | 8/1974 | Bottone | 318/645 |
| 4,100,789 | 7/1978 | Joyce | 73/31.04 |
| 4,937,598 | 6/1990 | Hine | 347/92 X |

FOREIGN PATENT DOCUMENTS

| | | | |
|---|---|---|---|
| 59-150751 | 8/1984 | Japan | B41J 3/04 |
| 62-44455 | 2/1987 | Japan | B41J 3/04 |

*Primary Examiner*—Joseph W. Hartary
*Attorney, Agent, or Firm*—Brumbaugh, Graves, Donohue & Raymond

[57] ABSTRACT

In the embodiments described in the specification, an ink jet system includes an ink jet head with an ink reservoir and a passage supplying ink from the reservoir to a plurality of pressure chambers from which ink drops are ejected through a corresponding plurality of orifices, along with a viscosity-detecting arrangement for detecting the viscosity of the ink supplied to the pressure chambers and a control system for controlling a heater so as to control the temperature of the ink in order to maintain viscosity at a desired level. In a particular embodiment, the ink-viscosity detector consists of four fluidic elements having different fluidic resistance and inertance values connected in a bridge circuit which is arranged to be balanced when the ink has the desired viscosity value.

9 Claims, 1 Drawing Sheet

INK JET PRINTHEAD WITH INK VISCOSITY CONTROL

BACKGROUND OF THE INVENTION

This invention relates to the control of ink viscosity in an ink jet printhead.

In ink jet printing, it is important to control the volume and velocity of the ink drops ejected from a printhead and applied to an adjacent substrate in order to maintain constant and good image quality. This is especially important in hot melt ink jet printing in which the viscosity of the ink can change significantly with temperature changes. Conventionally, the control of ink viscosity is achieved by selecting the constituents of the ink in such a way that the ink will have a desired viscosity at a specific temperature and then controlling the temperature of the printhead so that the ink is ejected at that temperature. Despite such efforts to control ink viscosity, however, the viscosity of ink used in ink jet printheads can vary because of aging of the ink or batch-to-batch variations in the ink or variations in ink temperature from one printhead to another or from time to time in the same printhead, resulting in image quality variations.

SUMMARY OF THE INVENTION

Accordingly, it is an object of the present invention to provide an ink jet printhead which overcomes the above-mentioned disadvantages of the prior art.

Another object of the invention is to provide an ink jet printhead in which image quality degradation resulting from ink viscosity variations is avoided.

These and other objects of the invention are attained by providing an ink jet printhead in which the viscosity of the ink supplied to the orifices in the ink jet printhead is detected and the ink is heated by a heater which is controlled in accordance with the detected viscosity so as to maintain the viscosity of the ink at a desired value. In one embodiment, the viscosity of the ink flowing to the orifices in the ink jet head is detected by passing it through a fluidic element bridge having branches with different fluid resistance and inertance characteristics and the ink heater is controlled to raise or lower the ink temperature so that the bridge is balanced, thereby maintaining the ink at the desired viscosity.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
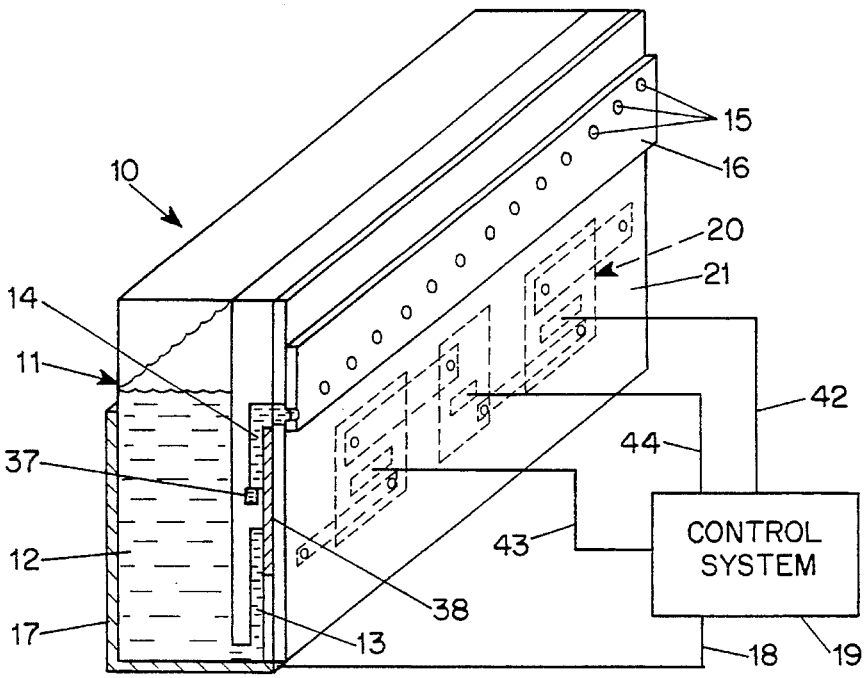
FIG. 1 is a schematic perspective view of a representative embodiment of an ink jet head arranged in accordance with the invention.

In the typical embodiment of the invention shown in FIG. 1, an ink jet head 10 has a reservoir 11 containing a supply of ink 12 which may, for example, be a hot melt ink which is solid at room temperature and is molten when heated to an application temperature of, for example, 120° C. and has a viscosity which decreases with increasing temperature in the vicinity of the application temperature. It will be understood, of course, that the invention is not limited to hot melt inks and may be used with any ink having a viscosity characteristic which changes with temperature in a temperature range including the application temperature.

Ink from the reservoir 12 is supplied through a passage 13 and a viscosity detector, described hereinafter, to a series of pressure chambers 14, only one of which is visible in the drawing, having electromechanical transducers which cause ejection of ink drops through a corresponding series of orifices 15 in an orifice plate 16 on the front surface of the ink jet head in the usual manner so as to selectively control application of ink drops to an adjacent substrate during operation of a system containing the ink jet head. In addition, a heater 17 is arranged to heat the ink in the reservoir 12 and the passage 13 leading to the pressure chambers 14 in response to power supplied through a line 18 from a control system 19 so as to control the temperature of the ink 12 and, accordingly, its viscosity. The ink jet head 10 may be of the type disclosed, for example, in the copending Hine application Ser. No. 08/143,165, filed Oct. 26, 1993, for "Ink Jet Head with Vacuum Reservoir" and/or the copending Hoisington et al. application Ser. No. 08/143,166, filed Oct. 26, 1993, for "Ink Jet Head with Ink Usage Sensor", the disclosures of which are incorporated by reference herein.

Figure 2:
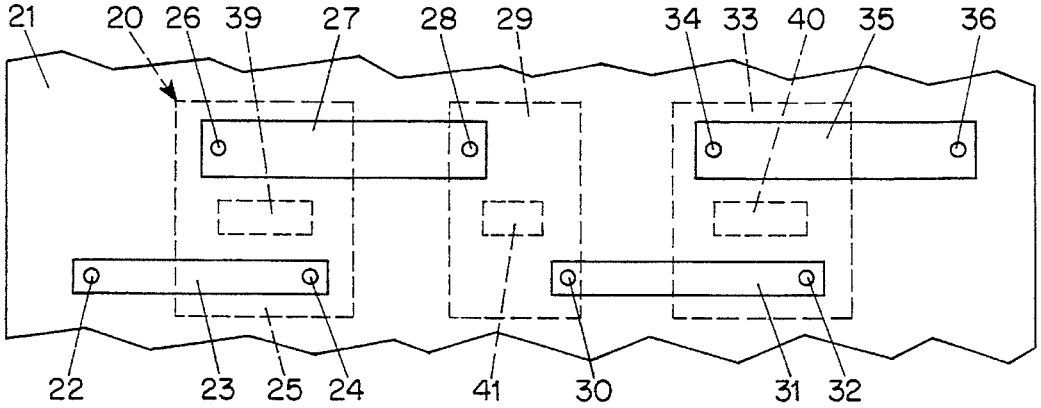
FIG. 2 is a fragmentary schematic view illustrating a typical fluidic element bridge arrangement for use in the embodiment shown in FIG. 1.

In accordance with the invention, the passage 13 leading from the reservoir 11 to the pressure chambers 14 includes a viscosity-detecting arrangement 20, shown schematically in dotted outline in FIG. 1 and in more detail in FIG. 2, for determining the viscosity of the ink 12 flowing to the pressure chambers 14. The typical viscosity detector 20 shown in the drawings consists, as best seen in FIG. 2, of a fluidic element bridge formed by channels of selected dimensions cut into a plate 21 adjacent to the passage 13 to provide predetermined fluid flow resistance and inertance values at a selected acoustic frequency together with pressure-generating and pressure-detecting elements located in adjacent chambers to determine a balanced condition of the bridge.

In the embodiment shown in FIG. 2, the ink flows from the passage 13 through an opening 22 in the plate 21 into a first fluidic element 23 of selected dimensions and from that element through an opening 24 into a chamber 25 which communicates through an opening 26 with a second fluidic element 27 of selected dimensions leading in turn through another opening 28 to a further chamber 29. The ink in the chamber 29 is supplied through an opening 30 to another fluidic element 31 of selected dimensions, which in this case is identical to the element 23, and through a further opening 32 into a chamber 33 from which the ink passes through an opening 34 into a fourth fluidic element 35, in this case identical to the element 27, and finally through an opening 36 into a passage 37 (FIG. 1) leading to the pressure chambers 14.

In order to generate pressure in each of the chambers 14 and thereby selectively eject ink drops through corresponding orifices 15, a piezoelectric sheet member 38 mounted adjacent to the rear wall of the plate 21 provides the electromechanical transducers for the pressure chambers 14. The plate 21 is shaped to form the fluidic passages 23, 27, 31 and 35 and the chambers 25, 29 and 33. Electrodes on the portion of the piezoelectric sheet 38 adjacent to the chambers 25 and 33 are configured to form piezoelectric shear mode pressure detectors 39 and 40, respectively, and electrodes on the portion of the piezoelectric sheet adjacent to the chamber 29 in the plate 21 form a shear mode pressure generator 41 oscillating at a selected frequency. In the typical arrangement shown schematically in FIG. 2, the fluidic elements 27 and 35 are each dimensioned so as to provide twice the fluidic resistance and half the fluidic inertance of the fluidic elements 23 and 31 at the frequency generated by the pressure transducer 41 and applied to the ink in the chamber 29.

When the viscosity of the ink is at a desired level at the ejection temperature, the pressures in the chambers 25 and 33, as detected by the pressure sensors 39 and 40 and transmitted to the control system over corresponding lines 43 and 44, respectively, will be equal and the control system 19 will then control the heater 17 through the line 18 so as to maintain the ink 12 at that temperature. If the pressure sensor 39 produces a pressure signal higher than that of the pressure sensor 40, producing an imbalance in the fluidic bridge because the ink has a viscosity above the desired value, the control system supplies more power through the line 18 to the heater 17 to increase the temperature of the ink 12 until the fluidic bridge is again balanced, indicating that the ink viscosity is at the desired level. If the pressure sensor 40 indicates a higher pressure than the pressure sensor 39, indicating an ink viscosity below the desired level, the control system will reduce the power supplied through the line 18 to the heater 17 so as to lower the temperature of the ink 12 until the desired viscosity level has been attained.

Figure 3:
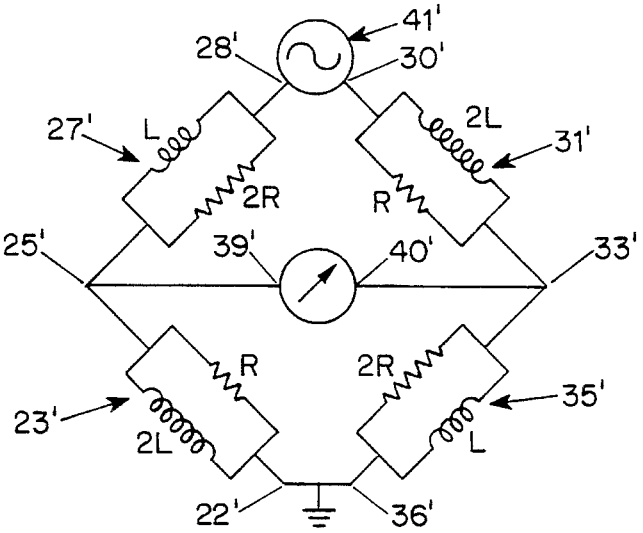
FIG. 3 is a schematic electrical circuit diagram showing the electrical analog of the fluidic element bridge shown in FIG. 2.

An equivalent electrical bridge circuit corresponding to the fluidic bridge circuit of FIG. 2 is illustrated in FIG. 3 with each of the corresponding electrical elements indicated by primed reference numerals. Thus, the pressure generator 41 is represented by a corresponding alternating current supply 41' and the fluidic elements 23, 27, 31 and 35 are represented by corresponding electric circuit components 23', 27', 31'and 35', with the components 27' and 35' having twice the resistance and half the reactance of the components 23' and 31'.

To provide the desired resistance and inertance values, the fluidic bridge components 23 and 31 may consist of rectangular channels formed in the plate 21 having a width w of 0.2 mm, a height h of 0.2 mm and a length l of 10 mm, whereas the fluidic elements 27 and 35, providing twice the resistance and half the fluidic inertance of the elements 23 and 31, may consist of channels formed in the plate 21 having a height h of 0.06 mm, a width w of 1.2 mm and a length l of 10 mm. In such fluidic elements, the inertance L and the resistance R are given by the formulas:

$$L=\frac{\rho l}{A};$$

$$R=12\frac{\mu l}{h^3 w} \text{ where } \frac{h}{w}<0.2;$$

and $$R=\frac{8\mu}{\pi}\left(\frac{h+w}{hw}\right)^4 l \text{ where } h\approx w.$$

Thus, for an ink having a density ρ of 0.9, i.e., 900 kg/m$^3$ and a viscosity μ of 25 milliPascal-sec., the fluidic elements 23 and 31 provide a resistance of $6.4\times10^{12}$ Pascal-sec./m$^3$ (R) and an inertance of $2.25\times10^8$ Pascal-sec.$^2$/m$^3$ (2L), whereas the fluidic elements 27 and 35 provide a resistance of $1.16\times10^{13}$ Pascal-sec-/m$^3$ (2R) and an inertance of $1.3\times10^8$ Pascal-sec.$^2$/m$^3$ (L). With this fluidic bridge circuit arrangement, balance is achieved when R=ωL where ω is the excitation frequency and a fluidic bridge having fluidic elements with the above-stated dimensions produces a balance for an ink having a viscosity of about 25 milliPascal-sec. at a frequency of about 8 kHz.

An ink jet head having a viscosity-detecting arrangement with the above-described fluidic elements provides sufficient ink flow rate characteristics to permit continuous recirculation of ink through a deaerator arrangement of the type described, for example, in the Hine et al. U.S. Pat. No. 4,937,598, the disclosure of which is incorporated by reference herein, so as to assure a continuous supply of fresh, deaerated ink to the viscosity detector and to the ink pressure chambers. Since the pressure generated by the pressure generator 41 is equal to the ink flow rate times the resistance, and assuming an ink displacement volume about equal to the volume of one drop during the operation of the viscosity-detection system, the ink flow rate is $0.95\times10^{-13}$ m$^3\times$50,000 rad/sec. (i.e., 8 kHz)=$4.75\times10^{-9}$ m$^3$/sec. The resistance is ¾ R=$4.8\times10^{12}$ Pascal-sec./m$^3$, producing a pressure of 22,800 Pascals, corresponding to 3.4 psi, which is large enough to measure, but small enough to handle conveniently.

Although the invention has been described herein with reference to specific embodiments, many modifications and variations therein will readily occur to those skilled in the art. Accordingly, all such variations and modifications are included within the intended scope of the invention.

We claim:

1. An ink jet system comprising orifice means for ejecting ink drops toward a substrate, pressure chamber means communicating with the orifice means for applying ink under pressure to the orifice means to eject drops of ink therefrom, ink supply means for supplying ink to the pressure chamber means, heater means for heating the ink supplied to the pressure chamber means and viscosity-detecting means including at least two components having different fluid resistance and inertance characteristics for detecting the viscosity of the ink supplied to the pressure chamber means.

2. An ink jet system according to claim 1 including control means responsive to signals from the viscosity-detecting means for controlling the heater means so as to maintain the ink viscosity at a desired level.

3. An ink jet system according to claim 1 wherein the viscosity-detecting means comprises fluidic bridge means including a plurality of fluidic elements having different fluidic resistance and inertance values through which ink passes from the ink supply means to the pressure chamber means, pressure-generating means for applying pressure to the ink in the fluidic elements and pressure-detecting means for detecting ink pressures in two branches of the fluidic element bridge.

4. An ink jet system according to claim 3 wherein the fluidic elements comprise rectangular channels formed in a plate and communicating with a pressure-generating chamber and with pressure-detecting chambers and including a piezoelectric sheet providing a pressure-generating portion adjacent to the pressure-generating chamber and pressure-detecting portions adjacent to the pressure-detecting chambers.

5. An ink jet system according to claim 4 wherein the pressure chamber means is formed in the plate and wherein the piezoelectric sheet includes transducer portions adjacent to the pressure chamber means arranged to be actuated to cause ejection of ink drops from the corresponding orifices.

6. An ink jet system according to claim 4 wherein the fluidic bridge means includes two branches, each containing two fluidic elements, one of which provides twice the resistance and half the inertance of the other fluidic element.

7. In an ink jet system, viscosity-detecting means including at least two components having different fluid resistance and inertance characteristics for detecting the viscosity of ink used in the system and heater means for heating the ink used in the system to maintain the viscosity of the ink at a selected level.

8. A viscosity-detecting arrangement for an ink jet system comprising a fluidic bridge including two branches, each having fluidic components with different fluidic resistance and inertance, pressure-generating means for applying oscillating pressure to ink in the two branches and pressure-detecting means for detecting the pressure of the ink in each of the branches of the fluidic bridge.

9. A viscosity-detecting arrangement according to claim 8 wherein each fluidic element comprises a rectangular channel and wherein the dimensions of the channels are selected to provide specific fluid resistance and inertance values.

* * * * *